US009200627B2

(12) United States Patent
Fagotti

(10) Patent No.: US 9,200,627 B2
(45) Date of Patent: Dec. 1, 2015

(54) NOISE MUFFLER FOR COMPRESSOR AND COMPRESSOR

(75) Inventor: Fabian Fagotti, Joinville SC (BR)

(73) Assignee: Whirlpool S.A., Sao Paulo (BR)

( * ) Notice: Subject to any disclaimer, the term of this patent is extended or adjusted under 35 U.S.C. 154(b) by 0 days.

(21) Appl. No.: 12/997,124

(22) PCT Filed: Jun. 18, 2009

(86) PCT No.: PCT/BR2009/000171
§ 371 (c)(1),
(2), (4) Date: Mar. 28, 2011

(87) PCT Pub. No.: WO2009/152594
PCT Pub. Date: Dec. 23, 2009

(65) Prior Publication Data

US 2011/0171046 A1 Jul. 14, 2011

(30) Foreign Application Priority Data

Jun. 18, 2008 (BR) ..... 08018901

(51) Int. Cl.
*F04B 39/00* (2006.01)

(52) U.S. Cl.
CPC ..... *F04B 39/0055* (2013.01); *F04B 39/0027* (2013.01); *F04B 39/0061* (2013.01)

(58) Field of Classification Search
CPC ..... F04B 39/0055; F04B 39/0061; F04B 39/0027
USPC ..... 417/312, 902; 181/229, 403, 238, 239
See application file for complete search history.

(56) References Cited

U.S. PATENT DOCUMENTS 4,370,104 A 1/1983 Nelson et al.
4,449,610 A 5/1984 Bar (Continued)

FOREIGN PATENT DOCUMENTS

GB 1017564 1/1966
WO WO 03/038280 5/2003

OTHER PUBLICATIONS

International Search Report mailed Sep. 23, 2009 for International application No. PCT/BR2009/000171.

(Continued)

*Primary Examiner* — Peter J Bertheaud
*Assistant Examiner* — Dominick L Plakkoottam
(74) *Attorney, Agent, or Firm* — Fay Sharpe LLP

(57) ABSTRACT

The present invention refers to a noise muffler for refrigeration compressors capable of dampening noise generated by the intermittent flow of the compressor and at the same time a muffler that reduces the loss of load in the refrigeration system. Accordingly, a noise muffler for a refrigeration compressor (1) is described, the muffler (1) including at least one suction chamber (2), the suction chamber (2) including at least one flow entry channel (3), the suction chamber (2) including at least one flow exit channel (4), the suction chamber (2) including at least one directional duct (5), the directional duct (5) including at least one first end (70), the directional duct (5) including at least one second end (80), the directional duct (5) including at least one flow control means (300), the first end (70) including an area substantially greater than the second end (80), the first end (70) being associated to the flow entry channel (3), the second end (80) being associated to the flow exit channel (4), the directional duct (5) being capable of directing a preferred flow (200) received at the first end (70) to the second end (80), the flow control means (300) being capable of offering reduced resistance to the passage of the preferred flow (200) and being capable of offering resistance in the opposite direction to the passage of the preferred flow (200).

8 Claims, 4 Drawing Sheets

(56) References Cited

U.S. PATENT DOCUMENTS

| | | | | |
|---|---|---|---|---|
| 4,755,108 | A | 7/1988 | Todescat et al. | |
| 5,971,720 | A | 10/1999 | Fagotti et al. | |
| 6,012,908 | A * | 1/2000 | Tanaka et al. | 417/312 |
| 6,105,716 | A | 8/2000 | Morehead et al. | |
| 6,715,582 | B2 * | 4/2004 | Nissen et al. | 181/231 |
| 7,316,291 | B2 | 1/2008 | Thomsen et al. | |
| 2004/0103683 | A1 * | 6/2004 | Yoon | 62/296 |
| 2004/0179955 | A1 * | 9/2004 | Lee | 417/312 |
| 2004/0247457 | A1 * | 12/2004 | Kim et al. | 417/312 |
| 2005/0006172 | A1 | 1/2005 | Thomsen et al. | |
| 2005/0031461 | A1 | 2/2005 | Lilie et al. | |

OTHER PUBLICATIONS

Reply to Written Opinion and International Search Report mailed May 27, 2010 for International application No. PCT/BR2009/000171.

International Preliminary Report on Patentability mailed Nov. 10, 2010 for International application No. PCT/BR2009/000171.

* cited by examiner

NOISE MUFFLER FOR COMPRESSOR AND COMPRESSOR

The present invention refers to a noise muffler for refrigeration compressors. More particularly, the invention refers to a noise muffler for compressors used in refrigeration circuits, whose arrangement permits a better ratio between noise dampening and efficiency.

The present invention further refers to a compressor for refrigeration circuit, having a noise muffler as defined in the present invention.

DESCRIPTION OF THE STATE OF THE ART

The main purpose of suction mufflers is to dampen the noise generated by an intermittent flow, which is inherent to the construction of compressors, and particularly for alternating-type compressors.

Generally, to enhance noise dampening in compressors, a muffler is used with an arrangement designed for the application of tube combinations and volumes (suction chambers), so that the number and geometry thereof vary in accordance with the frequency level for which increased dampening is desirable.

Normally, the bigger the loss of load in the muffler tubes, the greater the dampening obtained in the same equipment, but said loss of load implies in reduced efficiency of the compressor. Even greater dampening can be achieved by way of greater volumes, but greater volumes cause a higher heat exchange in the mufflers, which leads to a superheating of the vacuumed gas and consequent drop in efficiency.

In this light, it is known that the dimensioning of the tubes and volumes in a noise muffler is directly related to the desired commitment between noise dampening and efficiency of the compressor.

Document U.S. Pat. No. 4,449,610 reveals a muffler for cooling compressors having two identically structured shells, made from plastic material resistant to the chemical action of the cooling gas, but the same document does not provide a detailed description of the dampening caused by the muffler, nor the potential loss of efficiency developed thereby, since the whole system acts like a two-volume muffler comprising a communication channel, as shown in FIG. 2.

Document U.S. Pat. No. 4,755,108 discloses a suction system for refrigeration compressors having tubes capable of decreasing the heat exchange between the cooler gas and the muffler walls. It must be pointed out, however, that this solution takes into consideration the use of tubes such that the exit of one is directed to the entry of the subsequent tube, which causes negative implications from the noise point of view.

Document U.S. Pat. No. 4,370,104 describes a suction muffler for refrigeration compressors arranged based on two parts, and made of a plastic material. The assembly of the two parts reveals a cylinder-shaped muffler. The muffler is installed, as in other solutions of the state of the art, between the suction tube and the return line of the cooling gas. The object of the invention described in this document presents the relative advantage of using insulating material, meaning its heat transfer rate between the compressor parts is lower. In any case, the document does not reveal an optimal solution for noise dampening, maintaining the efficiency of the equipment.

Document U.S. Pat. No. 5,971,720 reveals a suction muffler for hermetic compressors, made from a hollow body, the hollow body being built of a heat insulating material. The muffler receives the cooling gas at one end of the duct, and same is sent to a second end of the duct, known as the suction end, from the hollow body.

The hollow body further comprises a deflector element and an inverted T-shaped portion, in order to define the entry and exit parts of the suction chamber. Said document offers a solution for the problem of heat exchanges related to the parts of the compressor during circulation of the cooling gas, but there is no critical approach on the noise reduction related with the efficiency of the compressor.

So, the inventions found in the state of the art present constructive aspects that usually do not take into consideration the directing of the flow, or disregard the constructive characteristics whereby it is possible to establish a better balance between noise dampening and compressor performance.

OBJECTIVES OF THE INVENTION

A first objective of the present invention is to provide a noise muffler for refrigeration compressor, capable of dampening the noise generated by the intermittent flow of the compressor and at the same time a muffler that reduces the loss of load.

It is also an objective of the present invention to provide a compressor for refrigeration circuit, having a suction muffler as defined in the present invention.

BRIEF DESCRIPTION OF THE INVENTION

One way of achieving the objective of the present invention is by means of a noise muffler for a refrigeration compressor comprising at least one suction chamber, the suction chamber comprising at least one flow entry channel, the suction chamber comprising at least one flow exit channel.

The suction chamber comprises at least one directional duct, and the directional duct comprises at least one first end and at least one second end, the directional duct comprising at least one flow control means, the first end comprising an area substantially greater than the second end, the first end being associated to the flow entry channel, the second end being associated to the flow exit channel, the directional duct being capable of directing a preferred flow received at the first end to the second end, the flow control means being capable of offering reduced resistance to the passage of the preferred flow and the flow control means being capable of offering increased resistance in the opposite direction to the passage of the preferred flow.

A second way of achieving the objective of the present invention is by providing a compressor for a refrigeration circuit, comprising a noise muffler as defined in the present invention.

BRIEF DESCRIPTION OF THE DRAWINGS

The present invention will now be described in greater detail, with references to the appended drawings, wherein.

DETAILED DESCRIPTION OF THE DRAWINGS

Figure 1:
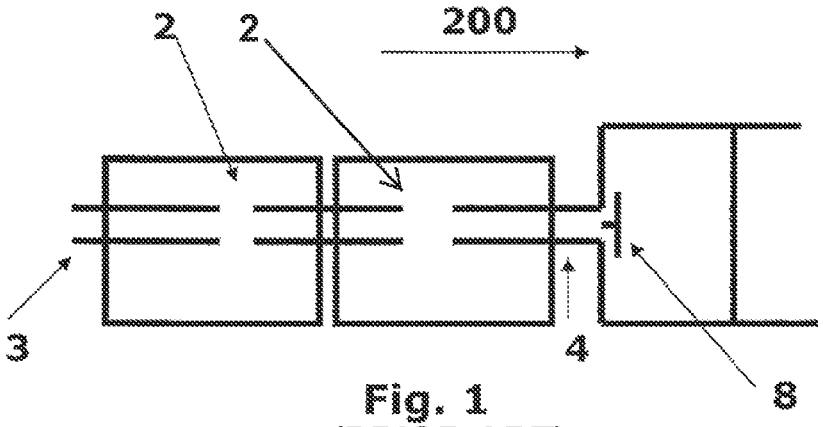
Fig. 1 (PRIOR ART)
FIG. 1—depicts a view of a suction muffler present in the state of the art.

FIG. 1 shows a suction muffler for a refrigeration compressor normally used in the state of the art. In FIG. 1 it is possible to note each suction chamber 2, also called volumes, as well as the tubes that are part of the respective muffler. The suction valve 8 is depicted in the same figure.

As mentioned previously, in this type of arrangement the muffler leads to a loss of load in each one of the volumes associated to the refrigeration circuit, and consequently reduces its efficiency.

A solution found to balance the efficiency and the noise reduction is presented by way of the present invention.

Figure 2:
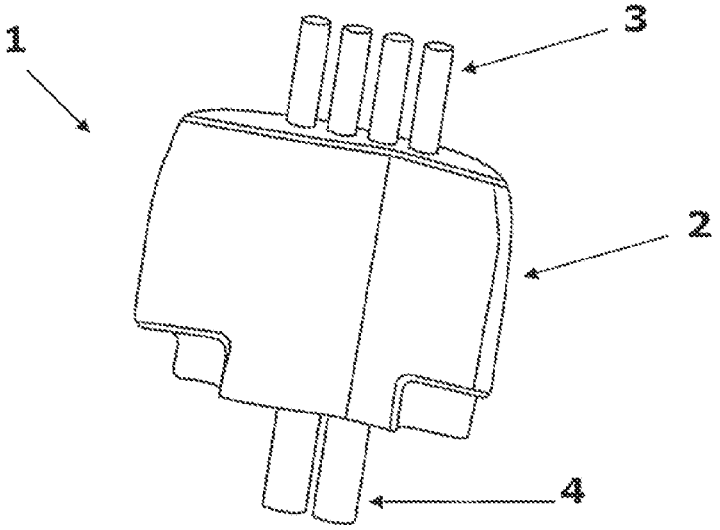
FIG. 2—depicts a perspective view of a suction muffler, which is the object of the present invention.
Figure 3:
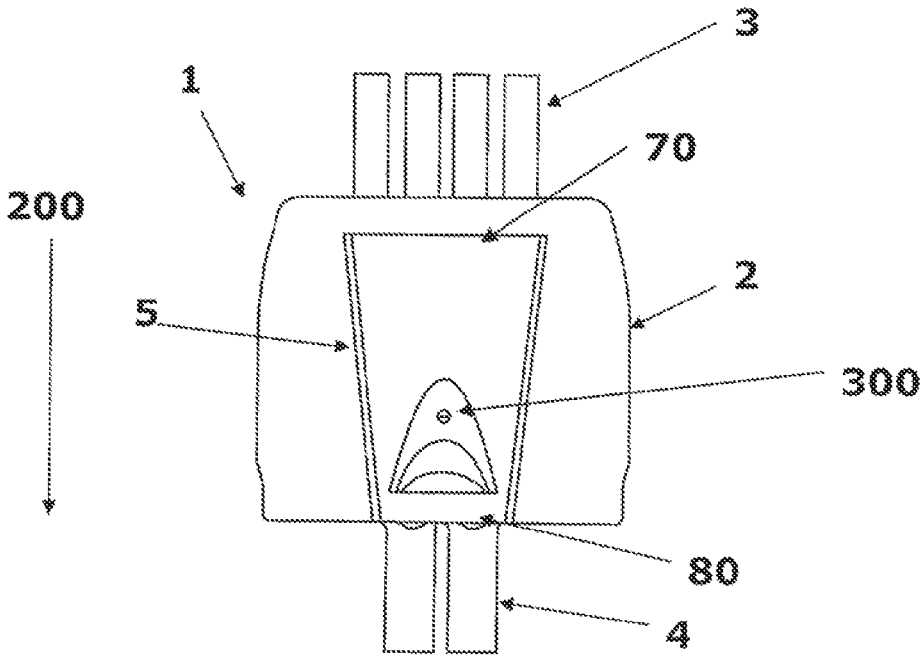
FIG. 3—depicts an upper sectional view of a first embodiment of the suction muffler, highlighting the main components of the object of the present invention.
Figure 4:
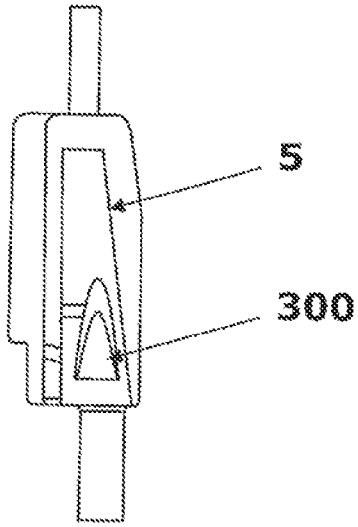
FIG. 4—depicts a side sectional view of a first embodiment of the suction muffler.

One of the embodiments of the invention is by way of a noise muffler for refrigeration compressor 1, as illustrated in FIGS. 2, 3 and 4.

The muffler 1 comprises at least one suction chamber 2, and the suction chamber 2 comprises at least one flow entry channel 3. Said flow entry channel 3 is a duct whose shape allows the flow of cooling gas on its inside.

The suction chamber 2 further comprises at least one flow exit channel 4, and the channel 4 is also disposed in the form of a duct. In the present invention, the suction chamber 2 comprises at least one directional duct 5, and the directional duct 5 comprises at least one first end 70, and one second end 80, as shown in FIG. 3. The same figure also shows that the second end 80 of the directional duct 5 is adjacent to the flow exit channel 4.

The directional duct 5 has a greater passage area than the passage area of the flow entry channel 3, and a greater area than the passage area of the flow exit channel 4.

Said duct 5 is, in the present invention, substantially aligned with the flow entry channel 3 and with the flow exit channel 4, as illustrated in FIG. 3.

A first end 70 comprises an area substantially greater than the second end 80, giving the duct 5 a trapezoidal shape. Optionally, other shapes can be adopted and implemented. It is important to note that the first end 70 is associated to the flow entry channel 3, and that the second end 80 is associated to the flow exit channel 4.

The primary characteristic of the directional duct 5 is to develop a convergence of the most part of the flow received in the entry channel 3, to the flow exit channel 4. The flow received at the first end 70, and directed to the second end 80, is called the preferred flow 200.

In this sense, the duct 5 minimizes the effect of contraction and subsequent expansion of the flow, which is a potential situation for greater loss of load. This approach further allows greater efficiency to be maintained for the whole system.

Another important characteristic, related to the use of the directional duct 5, is that the flow is substantially confined in a space with additional heat insulation in relation to the outside of the muffler 1, and normally at a higher temperature than the vacuum flow. The additional heat insulation is provided by the wall of the directional duct 5 itself.

As mentioned, the duct 5 is provided, preferably solidarily to the bottom region of the suction muffler 1, with little or no communication area with the inner surface of the suction chamber 2. Optionally, the duct 5 is not solidary to the bottom region of the suction muffler 1.

Said arrangement favors a confinement of the flow, implying in the maintenance of an average pressure in the antechamber of the suction valve(s).

A communication between the final section of the directional duct 5, and the inner environment of the suction muffler 1, can be developed in some cases to provide for the drainage of oil potentially carried by the flow, but this communication would cause a restriction upon the greater flow than the passage section of the duct 5.

Figure 7:
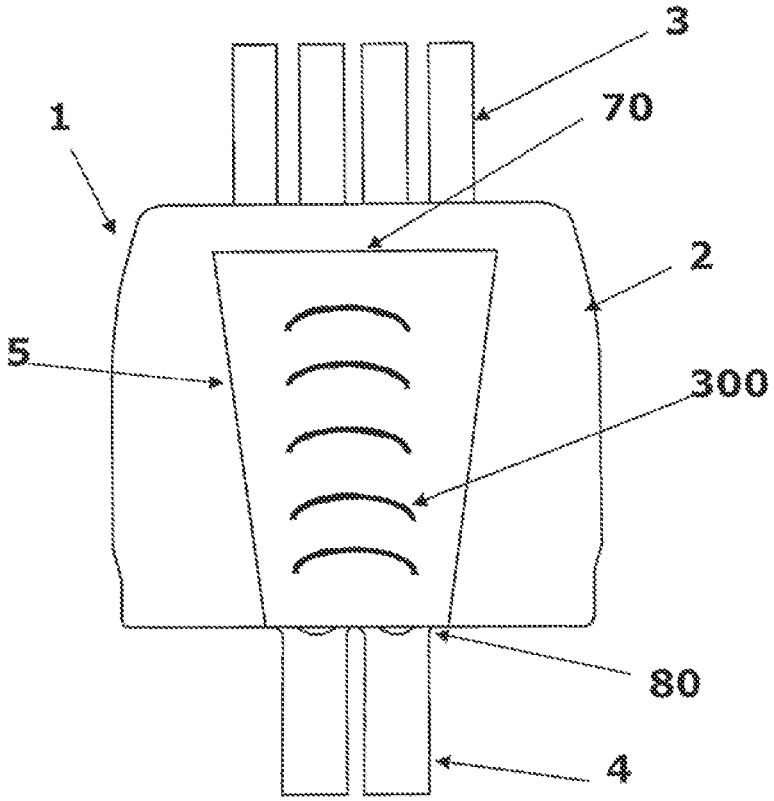
FIG. 7—depicts an upper sectional view of a second embodiment of the suction muffler, highlighting the main components of the object of the present invention.

The directional duct 5 comprises at least one flow control means 300. Preferably, the flow control means 300 is disposed adjacent to the second end 80. However, FIG. 7 shows in the optional arrangement formed by a plurality of means 300. In this case, the means 300 are distributed along the directional duct 5. FIGS. 3 and 4 show the allocation of the flow control means 300 in the preferred embodiment.

Figure 5:
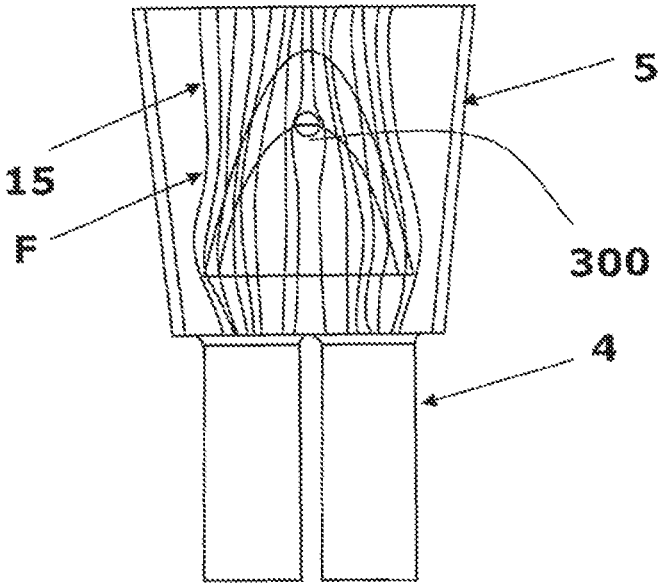
FIG. 5—depicts an upper sectional view of the object of the invention, highlighting the lines in the preferred flow direction and the flow deflector element.
Figure 6:
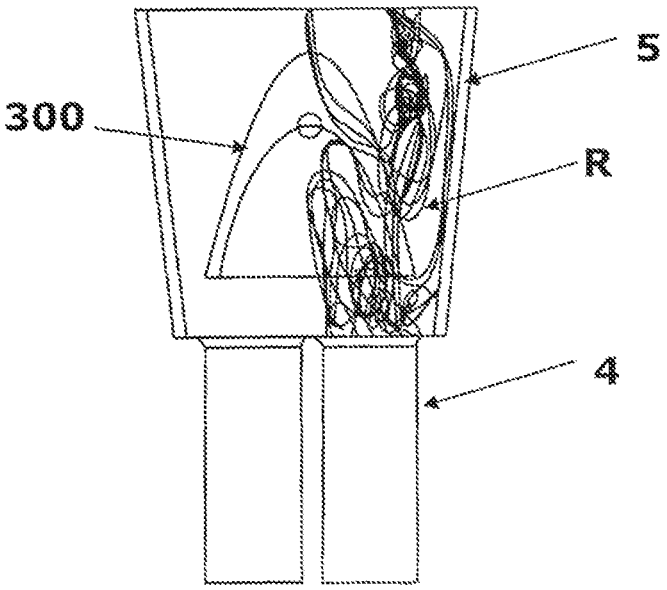
FIG. 6—depicts an upper sectional view of the object of the invention, highlighting the lines in the opposite direction to the preferred flow and the flow deflector element.

Preferably, the flow control means 300 is capable of offering reduced resistance to the passage of the preferred flow 200, as shown in FIG. 5. The flow control means 300 offers an increased resistance in the opposite direction to the passage of the preferred flow 200, as illustrated in FIG. 6. The region contrary to the passage of the preferred flow 200 is also known as the reflux region.

FIG. 5 further illustrates the flow lines 15 in the preferred condition 200.

An important aspect in relation to the flow control means 300, is that it has a convex surface in the region downstream of the preferred flow 200, as shown in FIGS. 5 and 6. The same flow control means 300 has a concave surface in the region downstream in the opposite direction to the preferred flow 200. In the present invention the flow control means 300 acts as a flow deflector.

It is possible to note, by means of FIGS. 5 and 6, the flow lines in the preferred direction 200, referenced by "F", as well as the flow lines in reflux direction "R". In the condition of flow "F" in the preferred direction 200, the lines encounter low resistance due to the arrangement of the flow control means 300, whereas in the condition of reflux "R" the flow lines sustain an impoundment in the region near the second end 80, characterizing a better balance between performance and noise dampening for the suction muffler 1 now proposed.

As mentioned previously, the flow control means 300 is located substantially near the second end 80 of the directional duct 5, as shown in FIGS. 3 and 4, but optionally the flow control means 300 can be disposed at a differentiated distance in relation to the second end 80.

Said arrangement of the flow control means 300 produces a minimum loss of load in the direction of the preferred flow 200, and a substantially larger loss of load in the reflux direction. Consequently, the pressure waves (pulsation) are mitigated by the intermittent working of the valve(s), that is, a greater noise dampening, and the maintenance of a greater pressure in the antechamber of the suction valve(s).

A loss of load having different characteristics in the flow and reflux conditions occurs due to a recirculation of the current lines, in the reflux condition. Recirculation does not occur in the direction of the preferred flow 200.

The concavity of the flow control means 300 acts as a barrier to the propagation of pressure waves that form in the reflux condition.

The present invention preferably refers to the use of a muffler comprised of a single suction chamber 2, but can optionally have mufflers with more than one chamber or volume, applying pairs of directional/deflector ducts in series, between the exit of each volume and the entry of the subsequent volume.

FIG. 7 shows an alternative embodiment, in which it is possible to note the presence of sequential curve deflectors. Said arrangement allows the flow to exit in a preferred direction, as in the preferred embodiment. In this case, the exit is substantially continuous in the flow condition, and has a series of expansions in the reflux condition.

Lastly, it should be emphasized that the subject matter described in the present invention, related to the difference in loss of load in flow and reflux condition, has the advantage of establishing a pressure in the antechamber of the suction valve 8 normally greater than in other situations, favoring the opening of the valve in the following cycle, and decreasing the vacuum losses. Said approach leads to increased efficiency for the whole system, as well as lower amplitude pressure transients, which contributes to minimize the noise generated.

The use of suction mufflers, as described in the present invention, is provided for compressors applied in refrigeration circuits.

Having described an example of a preferred embodiment, it should be understood that the scope of the present invention encompasses other possible variations, being limited only by the content of the appended claims, potential equivalents being included therein.

The invention claimed is:

1. Noise muffler for a refrigeration compressor, the muffler comprising at least one suction chamber, the suction chamber comprising at least one flow entry channel, the suction chamber comprising at least one flow exit channel, wherein the suction chamber comprises, inside, at least one cone-shaped directional duct, the directional duct being aligned straight with the flow entry channel and also being aligned straight with the flow exit channel and comprising at least one first end and at least one second end, the first end being larger than the second end, the first end being oriented toward the flow entry channel, the second end being oriented toward the flow exit channel, the cone-shaped directional duct comprising at least one cone-shaped flow control means disposed adjacent to the second end, the flow control means comprising a convex surface oriented toward the first end and a concave surface oriented toward the second end, the flow control means comprising a variable cross-section area, the variable cross-section area varying from a smaller cross-section area to a larger cross-section area, the smaller cross-section area being directed to the first end of the directional duct and the larger cross-section area being directed to the second end of the directional duct, the variable cross-section area being configured to form a constant opening angle from the smaller cross-section area to the greater cross-section area, the flow control means being configured to allow a preferred flow of refrigerant gas moving in a preferred flow direction from the flow entry channel of the suction chamber toward the flow exit channel of the suction chamber and configured to act as a flow deflector and reduce a non-preferred reflux flow of the refrigerant gas moving in a direction opposite the preferred flow direction from the flow exit channel of the suction chamber toward the flow entry channel of the suction chamber.

2. Noise muffler for a refrigeration compressor, according to claim 1, wherein the directional duct has a greater passage area than the passage area of the flow entry channel.

3. Noise muffler for refrigeration compressor, according to claim 1, wherein the directional duct has a greater passage area than the passage area of the flow exit channel.

4. Noise muffler for a refrigeration compressor according to claim 1, wherein the second end of the directional duct is adjacent to the flow exit channel.

5. Noise muffler for a refrigeration compressor, according to claim 1, wherein the muffler comprises a plurality of suction chambers.

6. Noise muffler for a refrigeration compressor, according to claim 1, wherein the directional duct that is aligned straight with the flow entry channel and aligned straight with the flow exit channel comprises the flow control means disposed inside the directional duct, and wherein the first end of the directional duct comprises an area substantially greater than the second end such that the directional duct converges toward the flow exit channel such that the directional duct develops a convergence of the flow received at the entry channel toward the flow exit channel and such that the directional duct minimizes the effect of contraction and subsequent expansion of the flow.

7. Noise muffler for a refrigeration compressor, the muffler comprising at least one suction chamber, the suction chamber comprising at least one flow entry channel, the suction chamber comprising at least one flow exit channel, wherein the suction chamber comprises, inside, at least one cone-shaped directional duct, the directional duct being aligned straight with the flow entry channel and also being aligned straight with the flow exit channel, the directional duct comprising at least one first end and at least one second end, the first end being oriented toward the flow entry channel, the second end being oriented toward the flow exit channel, and the directional duct being configured to direct a substantial part of a preferred flow of refrigerant received at the first end to the second end, the first end being larger than the second end, the directional duct further comprising at least one cone-shaped flow control means, the flow control means being disposed near the second end and comprising a convex surface and a concave surface, the convex surface of the flow control means being oriented toward the first end and configured to allow the preferred flow of refrigerant gas to move in a preferred direction from the flow entry channel of the suction chamber toward the flow exit channel of the suction channel, the concave surface of the flow control means being oriented toward the second end and configured to offer greater resistance and act as a flow deflector to a non-preferred reflux flow of refrigerant from the flow exit channel toward the flow entry channel as compared to the preferred flow of refrigerant from flow entry channel toward the flow exit channel, the flow control means comprising a variable cross-section area, the variable cross-section area varying from a smaller cross-section area to a greater cross-section area, the smaller cross-section area being close to the first end of the directional duct and the greater cross-section area being close to the second end of the directional duct, the variable cross-section area being configured to form a constant opening angle from the smaller cross-section area to the greater cross-section area.

8. Cone-shaped flow control means for a cone-shaped directional duct disposed inside a suction chamber of refrigeration compressor, the suction chamber comprising at least one flow entry channel and at least one flow exit channel, the directional duct being aligned straight with the flow entry channel and straight with the flow exit channel and comprising at least one first end and at least one second end, the first end being larger than the second end, the first end being oriented toward the flow entry channel, the second end being oriented toward the flow exit channel, the flow control means disposed inside the directional duct and further comprising a convex surface oriented toward the first end and a concave surface oriented toward the second end, the flow control means being configured to allow a preferred flow of refrigerant gas moving in a preferred flow direction from the flow entry channel of the suction chamber toward the convex surface of the flow control means and then toward the flow exit channel of the suction chamber, the flow control means comprising a variable cross-section area, the variable cross-section area varying from a smaller cross-section area to a greater cross-section area, the smaller cross-section area being close to the first end of the directional duct and the greater cross-section area being close to the second end of the directional duct, the variable cross-section area being configured to form a constant opening angle from the smaller cross-section area to the greater cross-section area, the flow control means also being configured to act as a flow deflector and reduce a non-preferred reflux flow of the refrigerant gas moving in a direction opposite the preferred flow direction from the flow exit channel of the suction chamber toward the concave surface of the flow control means and toward the flow entry channel of the suction chamber.

* * * * *